United States Patent [19]

Garay et al.

[11] Patent Number: 4,504,834

[45] Date of Patent: Mar. 12, 1985

[54] COAXIAL DIPOLE ANTENNA WITH EXTENDED EFFECTIVE APERTURE

[75] Inventors: Oscar M. Garay, N. Lauderdale; Kazimierz Siwiak, Sunrise; Quirino Balzano, Plantation, all of Fla.

[73] Assignee: Motorola, Inc., Schaumburg, Ill.

[21] Appl. No.: 452,167

[22] Filed: Dec. 22, 1982

[51] Int. Cl.[3] ..... H01Q 9/16

[52] U.S. Cl. ..... 343/749; 343/792; 343/802

[58] Field of Search ..... 343/790–794, 343/745, 750, 802, 807, 702, 822, 825, 828, 900, 895, 722, 749, 752, 820, 821, 850, 859, 860, 865, 898, 899, 904, 905

[56] References Cited

U.S. PATENT DOCUMENTS

| | | | |
|---|---|---|---|
| 2,82,170 | 2/1938 | Fucci | 343/790 |
| 2,184,729 | 12/1939 | Bailey | 343/830 |
| 2,311,472 | 2/1943 | Roosenstein | 343/791 |
| 2,492,404 | 12/1949 | Streib et al. | 343/791 |
| 2,615,131 | 10/1952 | Lindenblad et al. | 343/790 |
| 2,648,771 | 8/1953 | Cork | 343/792 |
| 2,802,210 | 8/1957 | Berndt | 343/792 |
| 2,825,756 | 3/1958 | Cary | 343/790 |
| 2,828,413 | 3/1958 | Bowers | 343/793 |
| 2,898,590 | 8/1959 | Pichitino | 343/722 |
| 3,048,845 | 8/1962 | Becker | 343/790 |
| 3,089,140 | 5/1963 | Monola | 343/722 |
| 3,438,042 | 4/1969 | Kuecken | 343/822 |
| 3,576,578 | 4/1971 | Harper | 343/792 |
| 3,623,113 | 11/1971 | Faigen | 343/792 |
| 3,818,488 | 6/1974 | Majkrzak et al. | 343/792 |
| 3,932,873 | 2/1976 | Garcia | 343/792 |
| 3,961,332 | 6/1976 | Middlemark | 343/792 |
| 3,980,952 | 9/1976 | Rapshys | 343/793 |
| 4,097,870 | 6/1978 | Fulmer, Sr. et al. | 343/792 |
| 4,117,492 | 9/1978 | Arnold et al. | 343/792 |
| 4,204,212 | 5/1980 | Sindoris et al. | 343/700 MS |
| 4,205,319 | 5/1980 | Gasparaitis et al. | 343/792 |
| 4,229,743 | 10/1980 | Vo et al. | 343/895 |
| 4,330,783 | 5/1982 | Toia | 343/792 |

FOREIGN PATENT DOCUMENTS

| | | | |
|---|---|---|---|
| 909583 | 4/1954 | Fed. Rep. of Germany | 343/749 |

OTHER PUBLICATIONS

The ARRL Antenna Book, published by the American Radio Relay League, Ch. 2, 14th edition pp. 2-1, 2-2, 1983.

*Primary Examiner*—Eli Lieberman
*Assistant Examiner*—Michael C. Wimer
*Attorney, Agent, or Firm*—Jerry A. Miller; James W. Gillman; Edward M. Roney

[57] ABSTRACT

A coaxial dipole antenna includes a first radiator which is approximately one quarter wavelength long. A second radiator exhibits length less than one quarter wave length and is coupled to the feed port by a reactive element which has an electrical reactance which is insufficient to increase the electrical length of the second radiator to one quarter of the wavelength. The length of a dipole antenna is substantially shortened while an effective aperture of one half wavelength is maintained by causing a portion of the transceiver housing to radiate in phase with the antenna.

14 Claims, 10 Drawing Figures

COAXIAL DIPOLE ANTENNA WITH EXTENDED EFFECTIVE APERTURE

BACKGROUND OF THE INVENTION

1. Field of the Invention

This invention relates generally to the field of dipole antennas and more particularly to dipole antennas which are designed for use with small portable transceivers where it is desirable to shorten the overall length of the antenna while retaining acceptable electrical performance.

2. Background of the Invention

As improved integrated circuit technology allows portable transceivers to be reduced in size, it is also desirable to reduce the overall length of the antenna structures used with such radios. Not only is reduction of the size of the antenna appealing from the point of view of aesthetics and marketability, it is also vital to the improved portability and inconspicuousness of such two-way transceivers. For example, such miniature transceivers are often utilized for security and surveillance applications where the size of the antenna is a limiting feature in the user's ability to conceal the transceiver and thereby attain maximum strategic effectiveness of the communication system.

One of the smallest antenna structures frequently used with portable transceivers is the quarter wavelength whip antenna. However, as one skilled in the art will readily appreciate, the quarterwave whip antenna requires an extensive ground plane or a large counterpoise at its base in order to radiate effectively and predictably. Since this is not generally the case with a portable transceiver, the radiation patterns and other electrical parameters are somewhat unpredictable and indeed vary drastically as a function of the manner in which the user holds, carries or uses the radio. A half-wave dipole antenna requires no such extensive ground plane and produces much more desirable and predictable electrical performance although it is considerably larger.

FIG. 1 shows a typical half-wave coaxial dipole antenna structure as is commonly used with portable transceivers. The prime disadvantage of this structure is that its length L is significantly longer than twice the length of a quarter-wave whip antenna and may even be substantially longer than the transceiver itself. It does, however, have excellent radiation characteristics.

In FIG. 1 a wire radiator 20, which is approximately one quarter of a wavelength in air, is fed by the inner conductor 25 of a coaxial transmission line 30. A dielectric insulator 32 separates inner conductor 25 from an outer conductor 35. The outer conductor 35 of coaxial transmission line 30 is electrically coupled to feed a metallic sleeve 40 which is also approximately one quarter of a wavelength in air. In order to improve the compactness of this antenna structure, metallic sleeve 40 is normally disposed about of a portion of coaxial transmission line 30, with a uniform dielectric spacer 45 positioned to maintain the proper physical relationship between the coaxial line 30 and the metallic sleeve 40. Dielectric spacer 45 is generally cylindrical in shape and serves to establish an outer transmission line 47 wherein the outer conductor is metallic sleeve 40 and the inner conductor is the outer conductor 35 of coaxial transmission line 30. This outer transmission line is approximately one quarter of a wavelength in the dielectric material of spacer 45. Outer transmission line 47 serves to choke off radiating currents in transmission line 30 and prevent excitation of the radio housing in order to properly control the electrical parameters of the dipole antenna.

FIG. 2 is a combined perspective view and current as a function of length diagram showing the relative magnitude of the antenna current I along the length of this half-wave dipole structure when the antenna is mounted to a transceiver housing. In this figure the length axis is not scaled but rather a perspective view of a transceiver with antenna is shown adjacent the graph to indicate where the relative current is present on a particular portion of the structure. The distribution of current I for this structure is consistent with that of a properly functioning half-wave dipole antenna of overall length L1. In operation, the outer coaxial transmission line effectively chokes off nearly all currents from the transceiver housing and only a small quantity of out-of-phase radiating currents are radiated by the transeiver housing. These currents cause only a slight deviation from the radiating pattern of an ideal dipole antenna.

Although this antenna structure is an effective radiator, its overall length L1 is approximately 200 mm for transceiver operation in the 860 MHz frequency range. As the size of modern transceivers decreases this is an unacceptably long antenna structure.

In a U.S. copending application, Ser. No. 452,166, filed Dec. 22, 1982, having the same Assignee as the present invention, a coaxial dipole antenna is disclosed which utilizes series inductance in a coaxial sleeve and a resonant tank on the wire radiator to obtain two sharp and distinct narrow resonant peaks.

SUMMARY OF THE INVENTION

It is an object of the present invention to provide an improved antenna for a portable transceiver.

It is another object of the present invention to provide a shortened coaxial dipole antenna structure for a portable transceiver which excites the transceiver's housing in order to extend the effective radiating aperture of the antenna structure.

It is another object of the present invention to provide an antenna structure which is substantially shorter than a half-wave dipole antenna yet provides approximately the same performance as a half-wave dipole.

It is a further object of the present invention to provide a coaxial dipole antenna structure exhibiting broad bandwidth and half-wave dipole performance in a considerably shorter configuration.

In one embodiment of the present invention a shortened dipole antenna for use with portable transceivers, includes a feed port having a first and a second input terminal and a first radiator element coupled at one end to the first input terminal. This first radiator element exhibits an electrical length approximately one quarter of a predetermined wavelength and extends outward from the feed port in a first direction. A second radiator element exhibits a length less than one quarter of the predetermined wavelength and extends outward from the feed port in a direction which is substantially diametrically opposed to the first direction. A reactive element couples the second radiator at the end closest to the feed port with the second input terminal and has an electrical reactance insufficient to increase the electrical length of the second radiator to one quarter of the predetermined wavelength.

The features of the invention believed to be novel are set forth with particularity in the appended claims. The invention itself however, both as to organization and method of operation, together with further objects and advantages thereof, may be best understood by reference to the following description taken in conjunction with the accompanying drawing.

DETAILED DESCRIPTION OF THE PREFERRED EMBODIMENT

Figure 1:
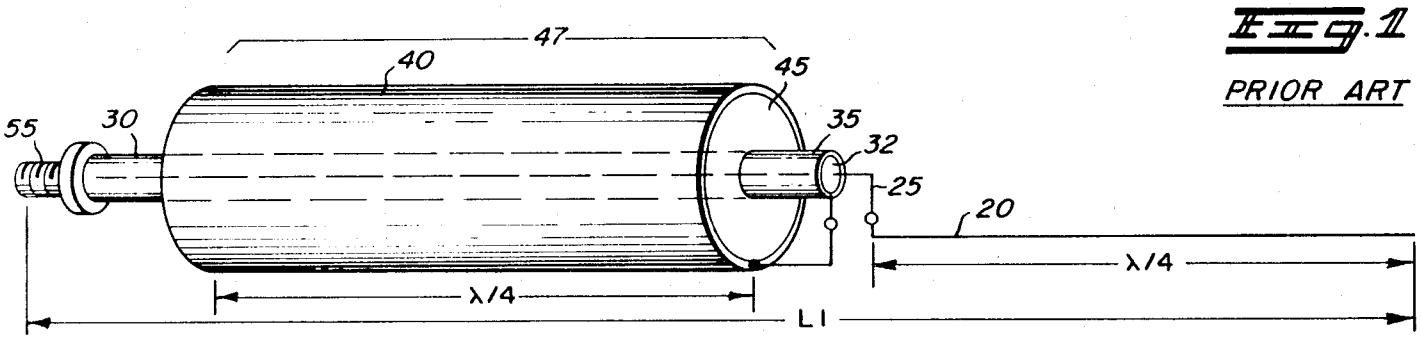
FIG. 1 PRIOR ART
FIG. 1 is a schematic representation of an ordinary coaxial dipole antenna of the prior art.
Figure 3:
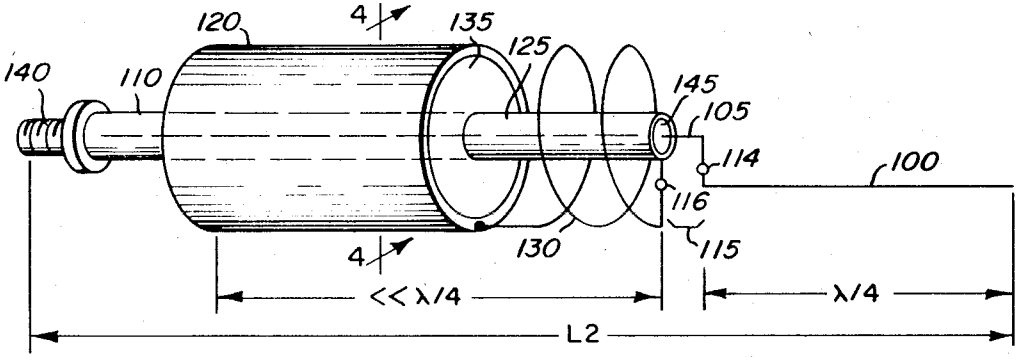
FIG. 3 is a schematic representation of the shortened coaxial dipole antenna of the present invention.

Turning now to FIG. 3, a wire radiator 100 having length of approximately one quarter of a wavelength in air at the predetermined frequency of interest is electrically coupled to be fed by the inner conductor 105 of a coaxial transmission line 110. The junction of the coaxial transmission line 110 and wire radiator 100 forms one circuit node or terminal 114 of feed port 115. A metallic sleeve radiator 120 is disposed about coaxial transmission line 110 and is substantially less than one quarter of the predetermined wavelength in air. In the preferred embodiment the length of the sleeve radiator 120 is approximately 0.084 wavelengths long in air at 860 MHz.

At a second circuit node or terminal 116 of feed port 115, the outer conductor 125 of coaxial transmission line 110 is coupled to one end of an inductor 130. The other end of inductor 130 is connected to metallic sleeve 120. The inductance value of inductor 130 is such that when placed in series with metallic sleeve 120 the equivalent electrical length of the series combination is still significantly less than one quarter of the predetermined wavelength in air. In the preferred embodiment, an inductor 130 has 1.2 turns of conductor, wound with the same diameter as the sleeve radiator and having a total length of 0.017 wavelengths has been found acceptable for operation at 860 MHz. A dielectric spacer 135 substantially cylindrical in shape maintains the proper physical relationship between metallic sleeve 120 and coaxial transmission line 110. The end of coaxial transmission line 110 is terminated in an appropriate connector 140 for connection to the transceiver.

Figure 4:
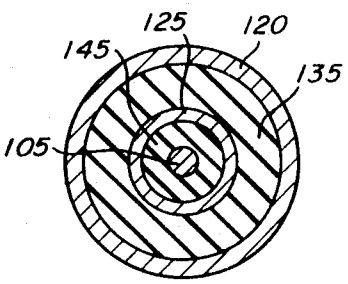
FIG. 4 is a cross-sectional view of the antenna of the present invention along lines 4—4 of FIG. 3.

FIG. 4 is a cross-sectional view along line 4—4 of FIG. 3 which more clearly shows the relative location of each of the elements within metallic sleeve 120 of the present invention. It is readily seen that coaxial transmission line 110 is made of an inner conductor 105 surrounded by a dielectric material 145 which is then covered with an outer conductor 125. In the preferred embodiment a 93 ohm coaxial transmission line, commercially available as RG 180, is used. Coaxial transmission line 110 is surrounded by dielectric spacer 135, which is preferrably made of Polytetraflourethylene such as Dupont Teflon® or similar substances with a dielectric constant of approximately 2.2, and is covered by metallic sleeve 120. As with the prior art dipole antenna a second transmission line is formed by the combination of outer conductor 125, dielectric spacer 135 and metallic sleeve 120. Unlike the prior art half-wave coaxial dipole, this second transmission line only attenuates or partially chokes off electro-magnetic energy from being transferred from the antenna to the transceiver housing. This partial attenuation is desired with the present invention to excite a portion of the radio housing electro-magnetically in order to produce in-phase radiation of energy therefrom. The sleeve is coupled, for example by stray capacitance, to a transceiver housing or other structure and excites it as if it were part of the antenna structure. This results in an effective radiating aperture of one half wavelength. The overall length of the resulting antenna structure L2 is substantially shorter than the length L1 of the prior art sleeve dipole. In fact, in the preferred embodiment of the present invention a 25% reduction in overall length was attained while obtaining superior performance between 820 MHz and 900 MHz.

Figure 5:
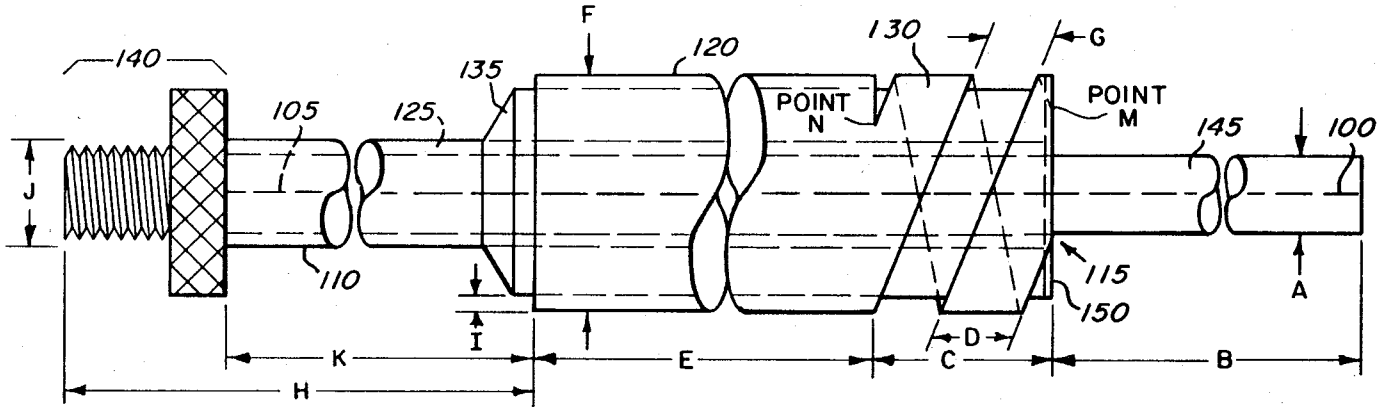
FIG. 5 is a side view showing the construction details of one embodiment of the antenna of the present invention.

FIG. 5 shows the critical details and dimensions for an embodiment of the present invention which is designed to operate in the range from approximately 820 to 900 MHz with a reflection coefficient of less than 0.3 throughout the designated frequency band. In this embodiment, the quarter wave wire radiator 100 is formed from the inner conductor 105 of coaxial transmission line 110 shown in phantom. The dielectric insulator 145 of the coaxial transmission line 110 is left in place along the entire length to enhance the structural rigidity of wire radiator 100. Due to the asymmetry in the structure at feed port 115 (more clearly shown in FIG. 3), the characteristic impedance at that port was found to be extraordinarily high for a dipole type structure. A measured impedance of approximately 200 ohms has been detected at the feed port. In order to transform that impedance to a more useful and desirable 50 ohms, a quarter wave coaxial transmission line 110 having characteristic impedance of 93 ohms is preferrably utilized and terminated in a 50 ohm SMA type connector. This provides impedance matching from the feed port 115 to connector 140.

Inductor 130 in the structure is preferably formed by cutting metallic sleeve 120 in a metallic strap helix-like configuration. In many instances it is estimated that the inductance requirement will result in less than 2 turns of the helix to form inductor 130. In the preferred embodiment the total rotational angle traversed by inductor 130 from point N to point M is approximately 426°. Connection from outer conductor 125 to inductor 130 is attained by a conductive cap 150. This conductive cap 150 is a disk or washer shaped metallic member having outer diameter approximately that of the dielectric spacer 135 and a hole in the center whose diameter is appropriate to allow passage of the wire radiator and dielectric insulator 145. This conductive cap 150 is electrically coupled, preferrably by soldering, to both inductor 130 and the outer conductor 125.

The principal dimensions A through K for the preferred embodiment as shown in FIG. 5 for this structure are tabulated below for operation between approximately 820 MHz and 900 MHz with a reflection coefficient of 0.3 or less and may be appropriately scaled for other frequency ranges:

| | |
|---|---|
| A | 2.6 mm |
| B | 72.0 mm |
| C | 5.8 mm |
| D | 2.5 mm |
| E | 29.5 mm |
| F | 7.9 mm |
| G | 2.0 mm |
| H | 42.9 mm |
| I | .5 mm |
| J | 3.7 mm |
| K | 28.9 mm |

These dimensions should be viewed as approximate as actual dimensions will vary slightly due to variations in construction practices, etc. These dimensions may also require a slight adjustment to account for differences in transceiver housings although in general the parameters of the transceiver housing are non-critical.

Figure 6:
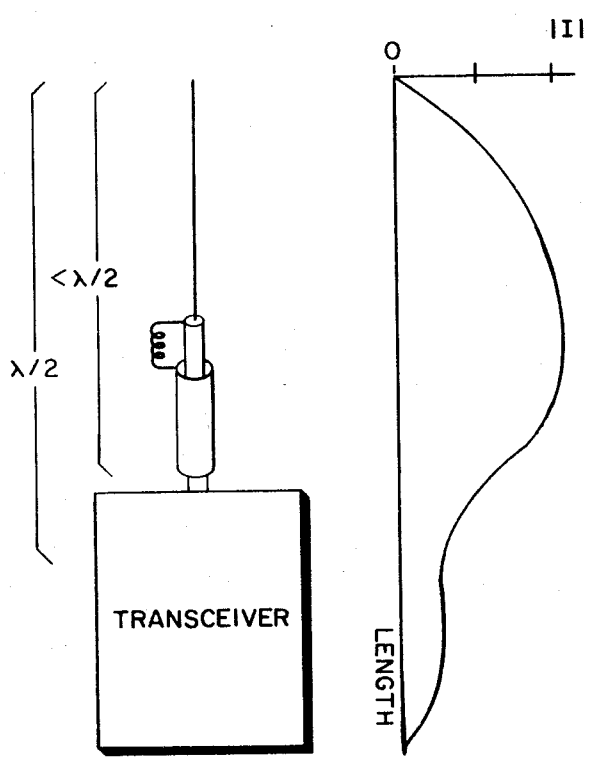
FIG. 6 shows the relative current magnitude along the length of the antenna of the present invention in a perspective view combined with a diagram of current as a function of length.
Figure 2:
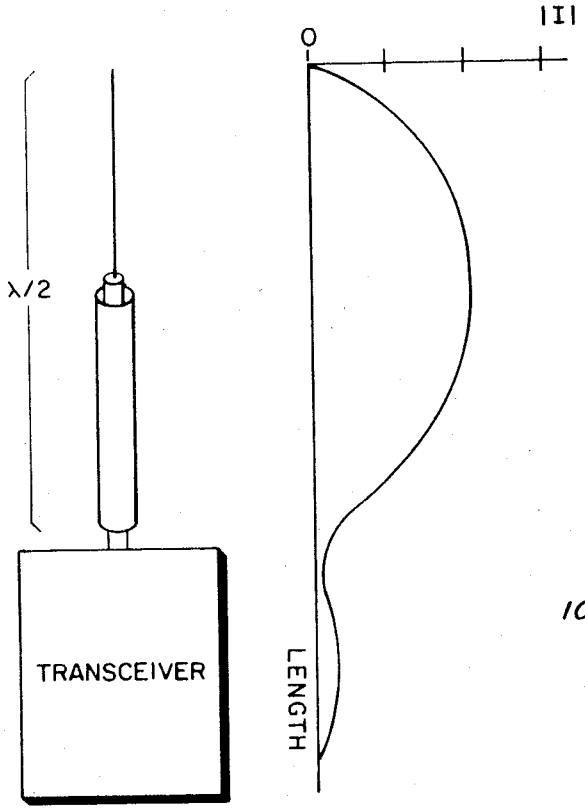
PRIOR ART FIG. 2
FIG. 2 shows the relative current magnitude along the length of the prior art coaxial dipole antenna of FIG. 1 in a diagram of current as a function of length combined with a perspective view.

The relative magnitude of the antenna current I is shown in FIG. 6 for the antenna of the present invention in a graph constructed similar to that of FIG. 2. It is evident that the upper portion of the transceiver housing or other mounting structure forms a substantial portion of the effective half-wave radiating aperture. Thus, this invention provides an effective half-wave radiation aperture similar to the half-wave dipole while occupying 25% less overall length in the preferred embodiment. It has been found that the current radiating from the housing is substantially in phase with the current along the antenna resulting in a positive reenforcement of transmitted energy rather than a cancellation. As would be expected some out-of-phase excitation also occurs in the lower portion of the ratio housing resulting in slight deviation from ideal dipole characteristics.

Figure 7:
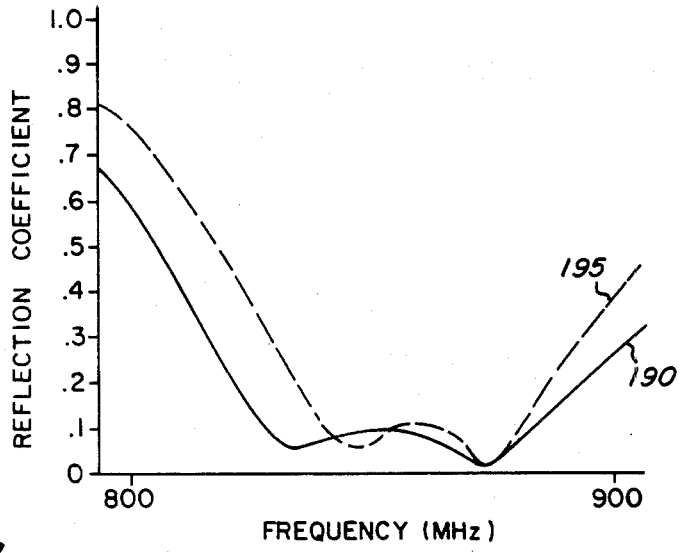
FIG. 7 is a plot showing the reflection coefficient of the antenna of the present invention as compared with that of the prior art half-wave coaxial dipole antenna.

FIG. 7 shows a plot of the magnitude of the reflection coefficient for the antenna of the preferred embodiment of the present invention, curve 190, compared with that of the prior art half-wave coaxial dipole, curve 195. The 0.3 reflection coefficient bandwidth of each antenna may be determined from this plot by reading the frequencies, from the horizontal axis, at which each curve intersects a horizontal line passing through the vertical axis at 0.3 and substracting the lower frequency from the higher frequency. It is evident from this plot that this invention produces an extremely low Q broadband antenna which is usable over a 20% broader range of frequencies than the prior art dipole assuming an antenna is useful for a reflection coefficient of less than 0.3.

Figure 8:
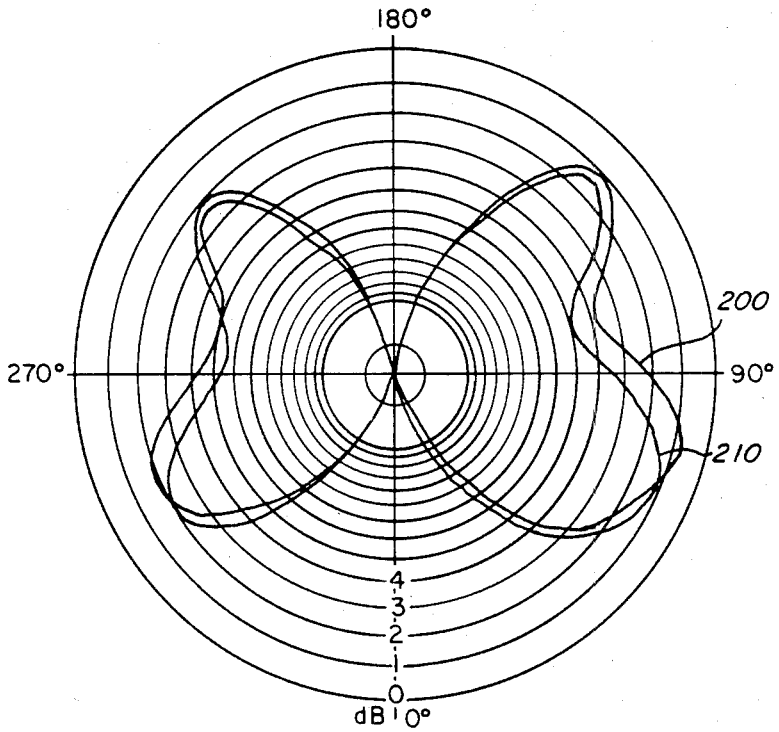
FIG. 8 is a plot showing the relative radiation pattern of the antenna of the present invention as compared with the prior art half-wave coaxial dipole antenna.

FIG. 8 shows actual radiation patterns of the antenna of the present invention as compared with the prior art coaxial dipole taken under identical conditions while individually mounted to the same transceiver housing. Curve 200 is for the prior art coaxial dipole while curve 210 is for the present invention. One skilled in the art will readily recognize that there is very little practical difference in the performance of these two antennas. In each case the butterfly wing shape of the curve is the result of stray out-of-phase excitation of the housing as is well known in the art. An ideal half-wave dipole would have a pattern that is closer to a figure 8 shape.

In the preferred embodiment, the present antenna is coated with a rubber material to improve its appearance and structural integrity. This rubber material slightly changes the effective electrical length of the wire radiator and the metallic sleeve as is also well known in the art. These characteristics may be compensated for by slightly adjusting the length of each of these elements until proper performance is attained. The overall result is a slight shortening of the elements relative to the dimensions necessary for the uncoated antenna.

Figure 9:
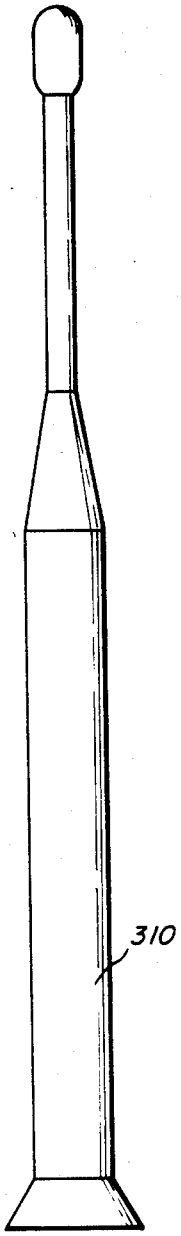
PRIOR ART Fig. 9
FIGS. 9 and 10 are a scaled perspective comparison of the present dipole compared with that of the prior art.
Figure 10:
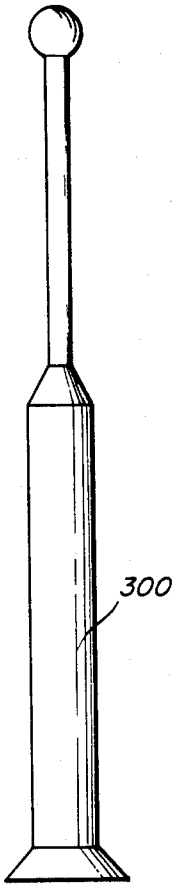

FIGS. 9 and 10 show the relative sizes and shape factors of the resulting antenna complete with rubber encapsulant of the present invention 300 as compared with that of the prior art coaxial dipole 310. A reduction of 50 mm in length (25%) was obtained in the preferred embodiment. The amount of length reduction attainable by this invention is of course dependent upon the frequency of operation along with the exact construction method.

Thus it is apparent that in accordance with the present invention an apparatus that fully satisfies the objectives, aims and advantages is set forth above. While the invention has been described in conjunction with a specific embodiment, it is evident that many alternatives, modifications and variations will become apparent to those skilled in the art in light of the foregoing description. Accordingly, it is intended that the present invention embrace all such alternatives, modifications and variations as fall within the spirit and broad scope of the appended claims.

What is claimed is:

1. A wide bandwidth shortened dipole antenna for use with portable transceivers, comprising:

a feed port including a first and a second input terminal;

a first radiator coupled at one end to said first input terminal and extending outward from said feed port in a first direction, said first radiator exhibiting electrical length of approximately one quarter of a predetermined wavelength;

a sleeve radiator extending outward from said feed port in a direction substantially diametrically opposed to said first direction and exhibiting electrical length less than one quarter of said wavelength;

a conductor physically longer than said sleeve radiator with a portion of said conductor disposed within said sleeve radiator, said conductor being electrically attached to said second input terminal, said conductor having a predetermined capacitance between said conductor and said sleeve radiator for extending the antenna's effective radiating aperture by exciting in-phase radiation by said conductor; and a reactive element coupling the end of said sleeve radiator closest to said feed port with said second input terminal, and having an electrical reactance sufficient to increase the electrical length of said sleeve radiator to one quarter of said wavelength.

2. The antenna of claim 1 wherein said reactive element is an inductor.

3. The antenna of claim 1 wherein said conductor includes portions of a housing for said transceiver.

4. The antenna of claim 1 wherein said first radiator is a thin wire radiator.

5. The antenna of claim 2 wherein said inductor has the same diameter as said sleeve.

6. The antenna of claim 5 wherein said inductor is a conductive strap helix-like structure and has less than two turns.

7. The antenna of claim 6 wherein said inductor traverses approximately 426° of rotation.

8. The antenna of claim 5 further including a coaxial transmission line having an inner conductor and an outer conductor, said inner conductor attached to said first input terminal and said outer conductor attached to said second input terminal, wherein said outer conductor forms at least a portion of said conductor.

9. The antenna of claim 8 wherein the diameter of the sleeve radiator is approximately three times as large as the diameter of the outer conductor of said transmission line.

10. The antenna of claim 8 wherein said coaxial transmission line has a characteristic impedance greater than 50 ohms.

11. The antenna of claim 10 wherein the characteristic impedance of said transmission line is approximately 93 ohms.

12. The antenna of claim 8 further including a dielectric spacer disposed between said coaxial transmission line and said sleeve.

13. The antenna of claim 12 wherein said dielectric spacer has a dielectric constant of approximately 2.2.

14. The antenna of claim 13 wherein said transmission line exhibits electrical length of substantially one quarter of said predetermined wavelength.

* * * * *